US011982137B2

(12) United States Patent
Ogundare et al.

(10) Patent No.: US 11,982,137 B2
(45) Date of Patent: May 14, 2024

(54) REEL CONTROL IN A COILED TUBING SYSTEM

(71) Applicant: Halliburton Energy Services, Inc., Houston, TX (US)

(72) Inventors: Oluwatosin Ogundare, Houston, TX (US); Radovan Rolovic, Houston, TX (US); Roshan Joy Jacob, Houston, TX (US); Ramalakshmi Somaskandan, Houston, TX (US); Daniel Joshua Stark, Houston, TX (US); Jeremy C. Nicholson, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 258 days.

(21) Appl. No.: 17/496,364

(22) Filed: Oct. 7, 2021

(65) Prior Publication Data

US 2023/0110623 A1 Apr. 13, 2023

(51) Int. Cl.

| | |
|---|---|
| ***E21B 19/00*** | (2006.01) |
| ***E21B 17/20*** | (2006.01) |
| ***E21B 19/22*** | (2006.01) |
| ***E21B 44/06*** | (2006.01) |

(52) U.S. Cl.

CPC ..... *E21B 19/008* (2013.01); *E21B 17/20* (2013.01); *E21B 19/22* (2013.01); *E21B 44/06* (2013.01)

(58) Field of Classification Search

CPC ..... E21B 19/008; E21B 19/22

See application file for complete search history.

(56) References Cited

U.S. PATENT DOCUMENTS

| | | | | |
|---|---|---|---|---|
| 10,323,471 | B2 | 6/2019 | Dobkins et al. | |
| 10,570,680 | B2 | 2/2020 | Andreychuk et al. | |
| 2007/0246261 | A1* | 10/2007 | Lowe | E21B 44/02 175/122 |
| 2016/0076325 | A1 | 3/2016 | Dykstra et al. | |
| 2018/0328160 | A1 | 11/2018 | Belaskie et al. | |
| 2019/0203575 | A1 | 7/2019 | Schlosser | |
| 2021/0262303 | A1 | 8/2021 | Venna et al. | |

FOREIGN PATENT DOCUMENTS

| | | |
|---|---|---|
| KR | 10-1617174 | 5/2016 |

OTHER PUBLICATIONS

International Search Report and Written Opinion for Application No. PCT/US2021/054695, dated Jun. 30, 2022.

* cited by examiner

*Primary Examiner* — Kristyn A Hall

(74) *Attorney, Agent, or Firm* — Thomas Rooney; C. Tumey Law Group PLLC

(57) ABSTRACT

A system is provided including a coiled tubing reel apparatus including a reel drum for storing a coiled tubing string spooled on the reel drum and a hydraulic reel drive motor that controls rotation of the reel drum. The system further includes a reel controller that determines an estimated reel back tension for a portion of the coiled tubing string between the reel apparatus and the injector based on a set of parameters related to a coiled tubing operation. The reel controller determines a target reel back tension to be applied to the portion of the coiled tubing string by adjusting the estimated reel back tension based on a historical job dataset. The reel controller then determines and sets a target hydraulic pressure of the reel drive motor to achieve the target reel back tension in the portion of the coiled tubing string.

27 Claims, 5 Drawing Sheets

REEL CONTROL IN A COILED TUBING SYSTEM

TECHNICAL FIELD

The present disclosure relates generally to well drilling and completion operations and, more particularly, to controlling a coiled tubing service reel in a coiled tubing system.

BACKGROUND

Reeled or coiled tubing has been run into wells for many years for performing certain downhole operations, including but not limited to completions, washing, circulating, production, production enhancement, cementing, inspecting and logging. Such tubing is typically inserted into a wellbore by a coiled tubing injector apparatus which generally incorporates a multitude of gripper blocks for handling the tubing as it passes through the injector. The tubing is flexible and can therefore be cyclically coiled onto and off of a spool, or reel, by the injector which often acts in concert with a windlass and a power supply which drives the spool, or reel.

BRIEF DESCRIPTION OF DRAWINGS

Some specific exemplary aspects of the disclosure may be understood by referring, in part, to the following description and the accompanying drawings.

Figure 1:
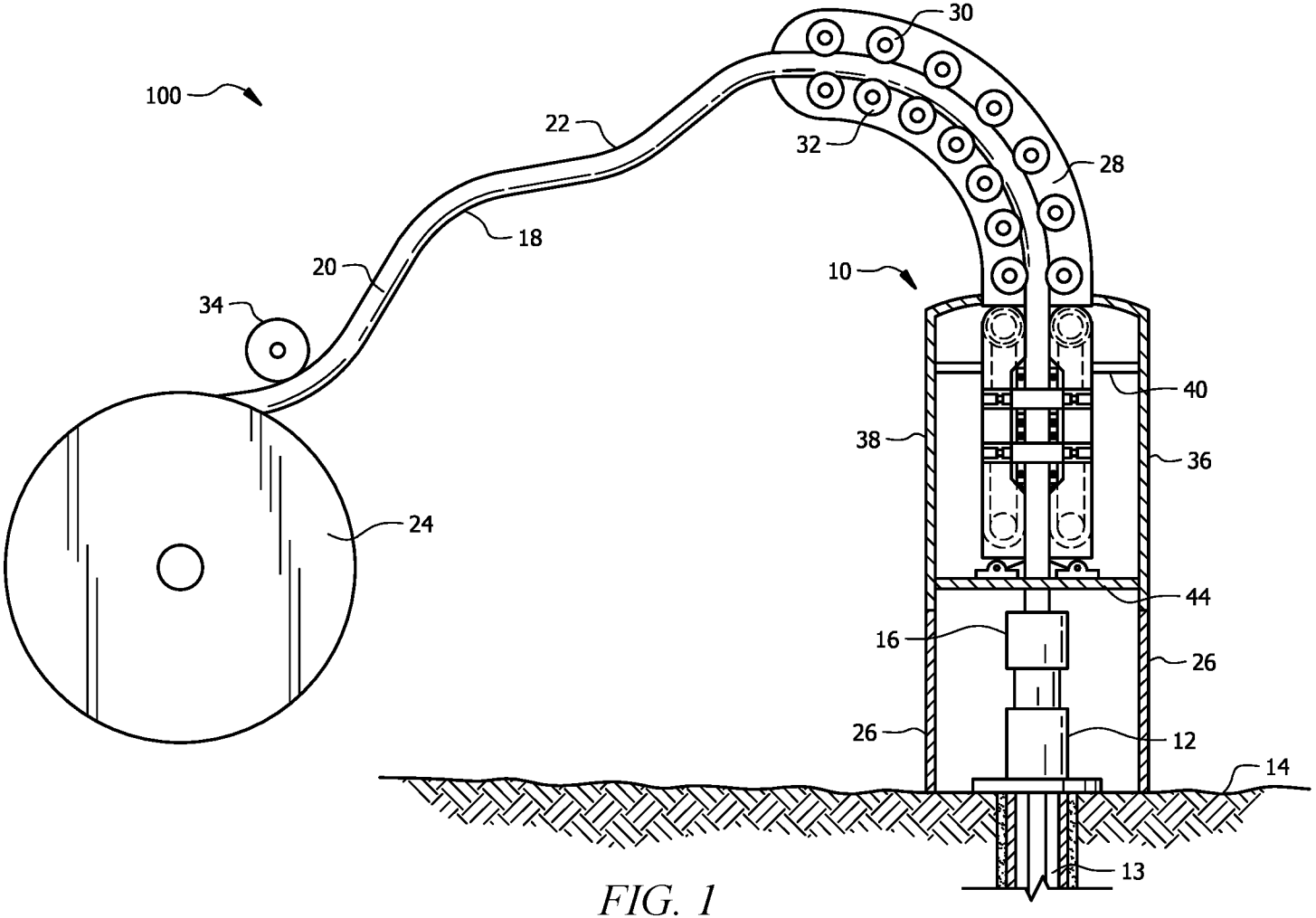
FIG. 1 is a schematic of an example coiled tubing injector system in which aspects of the present disclosure may be practiced.

While aspects of this disclosure have been depicted and described and are defined by reference to exemplary aspects of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described aspects of this disclosure are examples only, and not exhaustive of the scope of the disclosure.

DETAILED DESCRIPTION

Aspects of the present disclosure provide improved techniques for automatically determining a reel back tension to be applied to a coiled tubing and corresponding optimized hydraulic pressure to be set for a reel drive motor to achieve the reel back tension.

The disclosed system and methods provide several practical applications and technical advantages. For example, the disclosed system provides the practical application of automatically determining and setting an optimized reel back tension to be applied to a coiled tubing and corresponding optimized hydraulic pressure to be set for a reel drive motor to achieve the reel back tension. As described in accordance with one or more embodiments of the present disclosure, a reel controller may monitor a coiled tubing operation based on values of one or more parameters related to the coiled tubing operation, and determine an estimated reel back tension to be applied to the coiled tubing (e.g., including section of the coiled tubing between a coiled tubing reel and injector) based on the obtained parameter values. The parameters may include at least one parameter relating to one or more of properties of the coiled tubing, properties of the reel apparatus, properties of the injector, properties of a job category being performed using the coiled tubing, a job operation type being performed and other miscellaneous sensor derived data. The reel controller may adjust the estimated reel back tension based on a historical job dataset to generate an optimized target reel back tension to be applied to the coiled tubing. The historical job dataset includes data relating to target reel back tension values previously set or observed over the duration of a previously performed coiled tubing operation, and/or corresponding hydraulic pressures previously set or observed for the reel motor to achieve the respective reel back tension values. The reel back tension values and corresponding reel motor pressure values provided by the historical job dataset for each set of parameter values were determined to be optimal for the set of parameter values. Once the target reel back tension is determined, the reel controller may determine a target hydraulic motor pressure that is to be set for the reel motor to achieve the determined target reel back tension. The reel controller may send an electronic signal to a reel control circuit to adjust the hydraulic motor pressure of the reel motor to the determined target motor pressure.

The entire operation including monitoring a set of parameters related to the coiled tubing operation, determining an estimated reel back tension based on the monitored parameter values, determining an optimized target reel back tension by adjusting the estimated reel back tension, determining a target hydraulic pressure for the reel motor as a function of the target reel back tension, and adjusting the hydraulic motor pressure to the target motor pressure is designed to be fully automatic and not needing operator intervention. Thus, the disclosed system and methods significantly reduce operator burden. Further, by automatically adjusting the reel back tension throughout the reel operation based on a historical job dataset, the reel controller may ensure that the reel back tension at any point during the reel operation is not too low to prevent pipe buckling/springing or too high to damage the tubing and other equipment.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative aspects of the present disclosure are described in detail herein. In the interest of clarity, not all features of an actual implementation may be described in this specification. It will of course be appreciated that in the development of any such actual aspect, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

To facilitate a better understanding of the present disclosure, the following examples of certain aspects are given. In no way should the following examples be read to limit, or define, the scope of the invention. Aspects of the present disclosure may be applicable to horizontal, vertical, deviated, or otherwise nonlinear wellbores in any type of subterranean formation. Aspects may be applicable to injection wells as well as production wells, including hydrocarbon wells. Aspects may be implemented using a tool that is made suitable for testing, retrieval and sampling along sections of the formation. Aspects may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain aspects may be used in one or more of wireline (including wireline, slickline, and coiled tubing), downhole robot, MWD, and LWD operations.

FIG. 1 is a schematic of an example coiled tubing injector system 100 in which aspects of the present disclosure may be practiced.

As shown in FIG. 1, coiled tubing injector 10 (also referred to as injector head) is shown positioned above a wellhead 12 of a well 13 at a ground surface or subsea floor 14. A lubricator or stuffing box 16 is connected to the upper end of wellhead 12.

Coiled tubing 18, having a longitudinal central axis 20 and an outer diameter or outer surface 22, is supplied on a coiled tubing reel 24 (also referred to as service reel) and is typically several thousand feet in length. Tubing 18 of sufficient length may be inserted into the well 13 either as single tubing, or as tubing spliced by connectors or by welding. The outer diameters of the tubing 18 typically range from approximately one inch (2.5 cm) to approximately five inches (12.5 cm). The disclosed injector 10 is readily adaptable to even larger diameters. Tubing 18 is normally spooled from on a reel or drum 24 of the coiled tubing reel 24 typically supported on a truck (not shown) for mobile operations.

Injector 10 is mounted above wellhead 12 on legs 26. A guide framework 28 having a plurality of pairs of guide rollers 30 and 32 rotatably mounted thereon extends upwardly from injector 10.

Tubing 18 is supplied from the reel 24 and is run between rollers 30 and 32. As tubing 18 is unspooled from the reel 24, generally it will pass adjacent to a measuring device, such as wheel 34 which measures a linear distance of the coiled tubing 18 that has passed through the measuring device, wherein the linear distance is indicative of a depth of the coiled tubing 18 in the wellbore 13. Alternatively, the measuring device may be incorporated in injector 10.

Rollers 30 and 32 define a pathway for tubing 18 so that the curvature in the tubing 18 is slowly straightened as it enters injector 10. As will be understood, tubing 18 is preferably formed of a material which is sufficiently flexible and ductile that it can be curved for storage on reel 24 and also later straightened. While the material is flexible and ductile, and will accept bending around a radius of curvature, it runs the risk of being pinched or suffer from premature fatigue failure should the curvature be too severe. Rollers 30 and 32 are spaced such that straightening of the tubing 18 is accomplished wherein the tubing 18 is inserted into the well 13 without kinks or undue bending on the tubing 18. However, the disclosed injector 10 can be used for injecting, suspending, or extracting any generally elongated body.

In one example design, the coiled tubing injector 10 utilizes a pair of opposed endless drive chains which are arranged in a common plane. These opposed endless drive chains are often referred to as gripper chains because each chain has a multitude of gripper blocks attached therealong. The gripper chains are driven by respective drive sprockets which are in turn powered by a reversible hydraulic motor. Each gripper chain is also provided with a respective idler sprocket to maintain each gripper chain within the common plane. Both the drive sprockets and idler sprockets are mounted on a common frame wherein the distance between centers of all the sprockets are essentially of a constant distance from each other. That is, the drive sprockets are free to rotate, but are not free to move either vertically or laterally with respect to each other. The idler sprockets are not free to move laterally with respect to each other but are vertically adjustable within a limited range in order to set the amount of play in each gripper chain. Such vertical adjustment is made by either a mechanical adjusting means or a hydraulic adjusting means. Typically, for injectors having mechanical adjustment means, the adjustment is made when the injector 10 is not in operation.

The opposed gripper chains, preferably via the gripper blocks, sequentially grasp the tubing 18 that is positioned between the opposed gripper chains. When the gripper chains are in motion, each gripper chain has a gripper block that is coming into contact with the tubing 18 as another gripper block on the same gripper chain is breaking contact with the tubing 18. This continues in an endless fashion as the gripper chains are driven to force the tubing 18 into or out of the wellbore, depending on the direction in which the drive sprockets are rotated.

The gripper chain is provided with a predetermined amount of slack which allows the gripper chain to be biased against the tubing 18 to inject the tubing 18 into and out of the wellbore. This biasing is accomplished with an endless roller chain disposed inside each gripper chain. Each roller chain engages sprockets rotatably mounted on a respective linear bearing beam, referred to herein as a linear beam. A linkage and hydraulic cylinder mechanism allows the linear beams to be moved toward one another so that each roller chain is moved against its corresponding gripper chain such that the tubing facing portion of the gripper chain is moved toward the tubing 18 so that the gripper blocks can engage the tubing 18 and move it through the apparatus. The gripper blocks engage the tubing along a working length of the linear beam. Each gripper chain has a gripper block that contacts the tubing 18 at the top of the working length as a gripper block on the same chain is breaking contact at a bottom of the working length of the linear beam.

The fixed distance between each set of drive sprockets and idler sprockets requires some significant lateral movement in the gripper chain when engaged by the roller chain on the corresponding linear beam in order to allow the gripper chains to engage the tubing by way of the gripper blocks. The reason for having the requisite amount of lateral play in the gripper chains is to provide a limited amount of clearance between the gripper chains, upon moving the respective roller chains away from the vertical centerline of the injector, to allow the passage of tubing and tools having larger outside diameters or dimensions.

Figure 2:
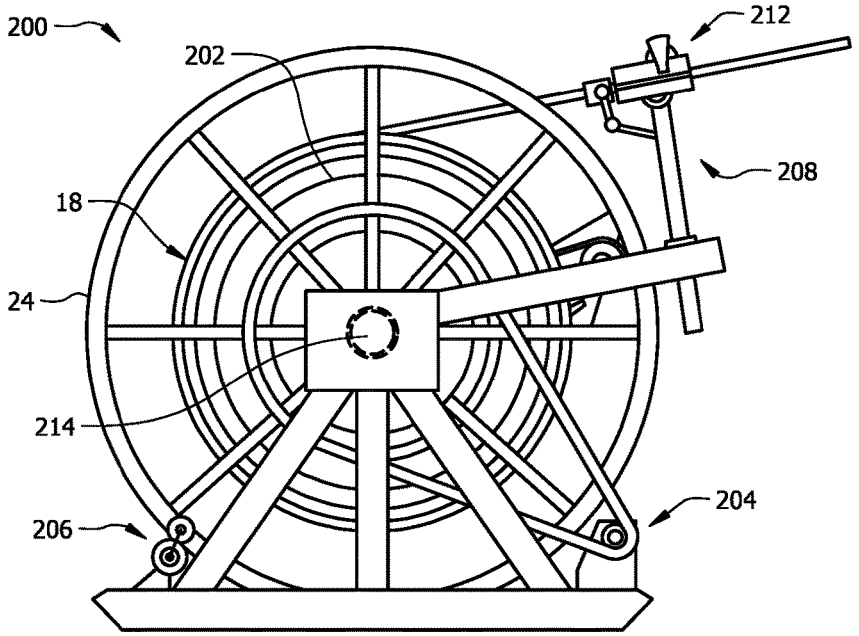
FIG. 2 illustrates an example coiled tubing reel apparatus in which one or more embodiments of the present disclosure may be practiced.

FIG. 2 illustrates an example coiled tubing reel apparatus 200 in which one or more embodiments of the present disclosure may be practiced.

The coiled tubing reel apparatus 200 is used to store and transport a coiled tubing string 18 ready for use at a wellsite. As shown in FIG. 2, the reel apparatus 200 includes a service reel 24 that stores coiled tubing pipe 18 spooled on a reel drum 202 of the service reel 24.

The radius of the reel drum 202 (often referred to as core radius) defines the smallest bending radius for the tubing 18. For coiled tubing 18 used repeatedly in well intervention and drilling applications, the core radius is generally configured to be at least 20 times the specified outside diameter of the coiled tubing pipe 18. This factor may be less for coiled tubing 18 that is to be bend-cycled only a few times, such as for permanent installations.

The rotation of the reel 24 is controlled by a hydraulic motor or reel motor 204, which may be mounted as a direct drive on the reel shaft 214, or operated by a chain-and-sprocket drive assembly. A hydraulic pressure in the reel motor 204 may be adjusted to control a torque exerted by the reel motor 204 onto the reel 24. The reel motor 204 is used to provide a given tension on the tubing 18, thereby maintaining the pipe 18 tightly wrapped on the reel 24. Backpressure is kept on the reel motor 204 during deployment, keeping tension on the tubing 18 between the injector 10 and reel 24. This tension being maintained on the tubing 18 by the reel motor 204 is commonly referred to as "reel back tension." An appropriate reel back tension should be maintained in a section of the coiled tubing 18 between reel 24 and injector 10 to prevent catastrophic pipe buckling. The amount of reel back tension required increases with an increase in outer diameter of the coiled tubing 18, yield strength (increased bending stiffness of the tubing 18), and distance between the reel 24 and injector 10. In addition, the required load on the reel drive system (e.g., including the reel motor 204 and the mechanism to drive the rotation of the reel 24 using the motor 204) increases as the size of the core radius decreases. The reel back tension on the coiled tubing 18 results in an axial load imposed onto the tubing guide 28 and creates a bending moment that is applied to the top of the injector 10. Therefore, it is critical that the injector 10 is secured properly so that the bending moment is not translated to the well-control stack components or wellhead.

During operations, the reel back tension also prevents the tubing from "springing." Although the coiled tubing 18 stored on a service reel 24 has been plastically deformed during the spooling process, the tubing 18 still has internal residual stresses that create a condition for potential unwrapping and outward springing of the tubing 18 from the reel if the back tension is released. To prevent the coiled tubing from "springing," the free end of the tubing must always be kept in tension.

The reel drive system must also produce the tension required to bend the coiled tubing 18 over the tubing guide arch 28 and onto the reel 24. When coiled tubing 18 is retrieved from the wellbore 13, the hydraulic pressure in the reel motor circuit is increased, providing the torque needed to allow reel rotation to keep up with the extraction rate of the tubing injector. Also, the reel motor 204 must have sufficient torque to accelerate the reel drum 202 from stop to maximum injector speed at an acceptable rate. The torque provided by the reel motor 204 needs to be capable of handling a fully loaded reel drum 202 with the tubing full of fluid.

A reel brake 206 may be provided as an additional safety mechanism. The primary function of the reel brake 206 is to stop the rotation of the reel drum 202 if the tubing 18 accidentally parts between the reel 24 and injector 10 and limit rotation of the reel 24 if a runaway condition develops. The reel brake 206 can also minimize tubing 18 on the reel 24 from springing in the case of loss of hydraulic pressure in the reel motor 204 and, thus, the loss in reel back tension. When the reel 24 is being transported, the reel brake 206 may be engaged to prevent reel rotation.

The tubing 18 is typically guided between the reel 24 and injector 10 using a mechanism called the "levelwind assembly 208," which properly aligns the tubing 18 as it is wrapped onto or spooled off the reel 24. The levelwind assembly 208 generally spans across the width of the reel drum 202 and can be raised to any height to line up the coiled tubing 18 between the tubing guide 28 and the reel 24. Generally, a mechanical depth counter 212 is mounted on the levelwind assembly 208, which typically incorporates a series of roller wheels placed in contact with the coiled tubing 18 and is designed to mechanically measure the footage of the tubing 18 dispensed through it. The levelwind assembly 208 needs to be strong enough to handle the bending and side loads of the coiled tubing 18. During transportation, the free end of the coiled tubing 18 is usually clamped to the levelwind assembly 208 to prevent springing.

Figure 3:
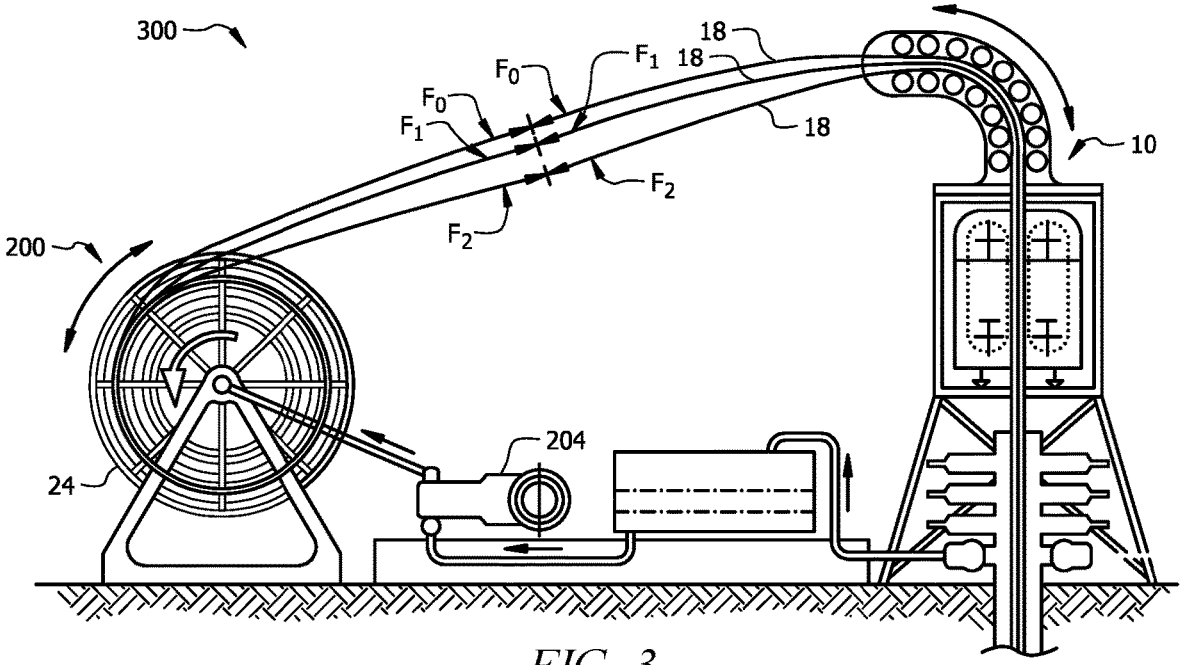
FIG. 3 illustrates an example deployment of coiled tubing during a coiled tubing operation.

FIG. 3 illustrates an example deployment 300 of coiled tubing 18 during a coiled tubing operation. As shown in FIG. 3 varying levels of reel back tension (shown as $F_0$, $F_1$ and $F_2$) may be applied to the section of the coiled tubing 18 between the reel 24 and injector 10. As described above, the reel back tension on the coiled tubing 18 may be adjusted by adjusting the hydraulic pressure of the reel motor 204 to apply an appropriate torque to the reel 24. For example, to increase the reel back tension on the coiled tubing 18, the hydraulic pressure of the reel motor 204 may be raised to exert an increased torque on the reel 24, causing the reel 24 to pull the coiled tubing 18 with an increase force. Similarly, to decrease the reel back tension on the coiled tubing 18, the hydraulic pressure of the reel motor 204 may be lowered to exert a decreased torque on the reel 24, causing the reel 24 to pull the coiled tubing 18 with a decreased force.

During operation of reel 24, the reel back tension applied to coiled tubing 18 must be maintained high enough to prevent pipe buckling and/or pipe springing, but not so much as to damage the coiled tubing string 18 (e.g., prevent pipe fatigue).

The appropriate reel back tension that needs to be applied to the coiled tubing 18 (e.g., to prevent pipe buckling, pipe springing, pipe fatigue etc.) and a corresponding amount of torque required to achieve and/or maintain the reel back tension depends on several factors including, but not limited to, one or more of properties of the coiled tubing 18, properties of the reel apparatus 200, properties of the injector 10, a type of operation being performed using the coiled tubing, and other miscellaneous sensor derived data. For example, reel back tension that must be applied to the pipe 18 and the corresponding amount of torque required to achieve the reel back tension may depend on the pipe outer diameter, yield strength of the pipe (which depends on pipe wall thickness), pipe bending radius on reel drum 202, length of pipe between the reel 24 and coiled tubing guide 28, efficiency of reel motor 204 etc. As described above, the amount of reel back tension required increases with an increase in outer diameter of the coiled tubing 18, yield strength (increased bending stiffness of the tubing 18), and distance between the reel 24 and injector 10. In addition, the required load on the reel drive system (e.g., including the reel motor 204 and the mechanism to drive the rotation of the reel 24 using the motor 204) increases as the size of the core radius decreases, thus needing a higher torque to maintain a given reel back tension.

The nature of operation (e.g., sand cleanout, acidizing etc.) being performed using the coiled tubing may also influence the required reel back tension and corresponding torque. Additionally, the required reel back tension and corresponding torque may vastly differ depending on whether the coiled tubing is being injected into the well 13 or being pulled out of the well 13. For example, when pulling the coiled tubing 18 out of the well 13, a higher reel back tension may need to be maintained so that the pipe 18 is tightly wound onto the reel drum 202.

When injecting a coiled tubing string 18 into the well 13 and/or pulling out the coiled tubing string 18 from the well 13, certain parameters related to the reel operation may change over the duration of the reel operation. For example, the wall thickness of the coiled tubing 18 may vary along the length of the coiled tubing 18. In some cases, a coiled tubing 18 may have up to 8 or 10 different thicknesses along the entire length of the coiled tubing 18. A section of the tubing 18 having a higher wall thickness may require to be maintained at a higher reel back tension than another section of the tubing 18 having a lower wall thickness. This means that the section of the tubing 18 having a thicker wall needs to be pulled by the reel 24 with a higher torque to achieve and maintain the required higher reel back tension. In another example, the bending radius of the tubing 18 may change throughout the operation. When the tubing 18 is being injected into the well 13 or being pulled out of the well 13, as the tubing 18 is spooled out or spooled onto the reel drum 202, the bending radius of the pipe 18 changes. The appropriate reel back tension and the corresponding torque that needs to be applied to the reel 24 also changes with the changing bending radius of the pipe 18.

Since the appropriate reel back tension to be applied to the coiled tubing 18 may change during operation of the reel 24, the hydraulic pressure of the reel motor 204 may need to be adjusted as needed throughout the reel operation to adjust the torque applied to the reel 24 so that an appropriate reel back tension is maintained throughout the reel operation.

In present coiled tubing injector systems, adjustment of the operating hydraulic pressure of the reel motor 204 is performed manually. For example, in most cases an operator sitting in an operator cabin visually observes the coiled tubing pipe 18 between the reel 24 and coiled tubing guide 28 and guesses whether the tubing 18 needs to be tighter or looser based on the operator's past experience. A knob is usually provided in the operator cabin that can be manually operated by the operator to adjust hydraulic pressure of the reel motor 204. If the operator thinks that the pipe 18 needs to be tighter, the operator manually turns the knob to increase hydraulic pressure of the reel motor 204 to generate a higher torque so that the reel 24 pulls on the pipe 18 stronger, thus raising the reel back tension of the pipe 18. On the other hand, if the operator thinks that the pipe 18 needs to be looser, the operator manually turns the knob to decrease the hydraulic pressure of the reel motor 204 to generate a lower torque so that the reel 24 eases the pull on the pipe 18, thus lowering the reel back tension on the pipe 18.

Visually observing the coiled tubing 18 and making manual adjustments to the hydraulic pressure of the reel motor 204 throughout the reel operation places considerable burden on the operator. Further, adjusting the reel back tension of the coiled tubing 18 based on visual observation is prone to errors. For example, a misjudgment in determining the appropriate reel back tension and/or an error in manually setting the hydraulic pressure of the reel motor 204 may lead to too little reel back tension resulting in catastrophic pipe buckling or too much reel back tension resulting in pipe damage.

Aspects of the present disclosure discuss techniques for automatically monitoring one or more parameters related to a coiled tubing operation, intelligently determining a reel back tension force to be applied to the coiled tubing and corresponding hydraulic pressure to be applied to the reel motor (e.g., reel motor 204) to achieve the reel back tension, and automatically setting the determined hydraulic pressure for the reel motor.

Figure 4:
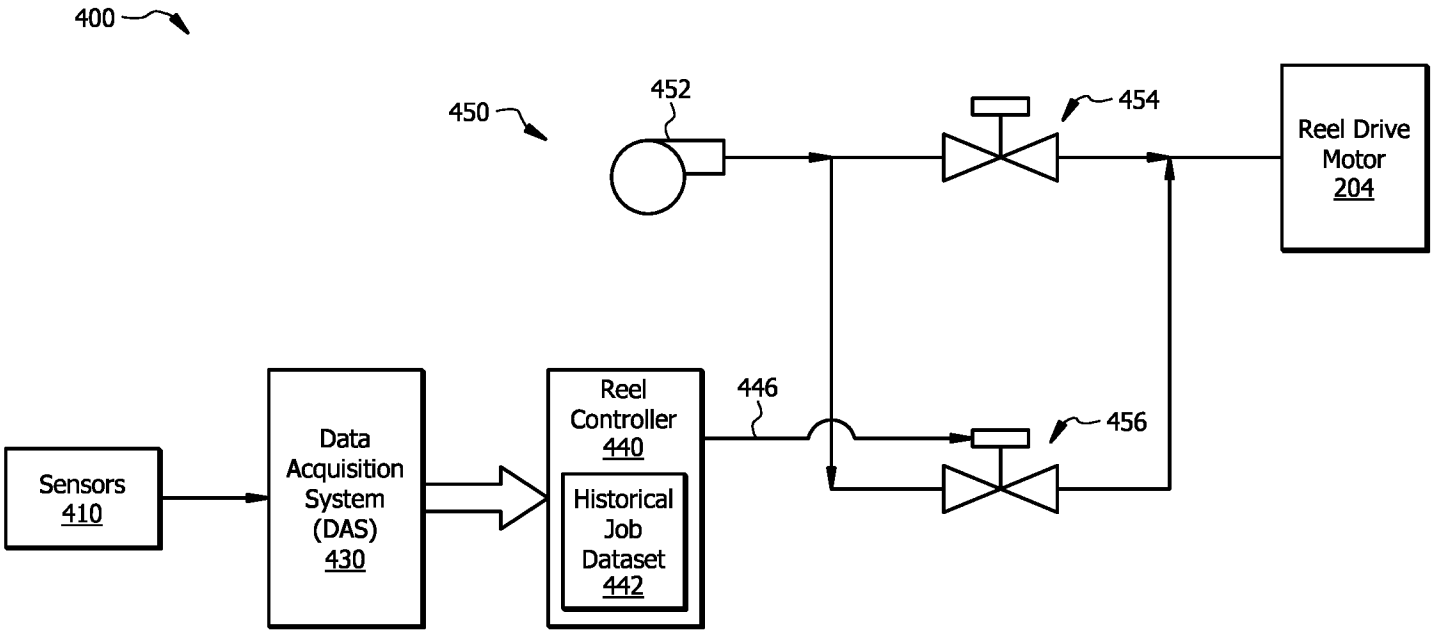
FIG. 4 illustrates a schematic diagram of an example system for adjusting hydraulic pressure of a reel drive motor shown in FIG. 2, in accordance with one or more embodiments of the present disclosure.

FIG. 4 illustrates a schematic diagram of an example system 400 for adjusting hydraulic pressure of a reel drive motor (e.g., 204) shown in FIG. 2, in accordance with one or more embodiments of the present disclosure.

As shown in FIG. 4, system 400 includes a data acquisition system (DAS) 430, a reel controller 440 and a hydraulic reel control circuit 450. DAS 430 may be configured to collect data relating to one or more of properties of the coiled tubing 18, properties of the reel apparatus 200, properties of the injector 10, properties of a job category being performed using the coiled tubing, a job operation type being performed and other miscellaneous sensor derived data. For example, as shown in FIG. 4, system 400 may include one or more sensors 410 to measure one or more parameters during a coiled tubing operation and feed the measured data to the DAS 430. For example, a sensor 410 may measure a depth related to the coiled tubing 18. Depth may refer to a length of the coiled tubing 18 in the wellbore 13. The depth parameter may be used to determine properties (e.g., coiled tubing wall thickness) of a section of the coiled tubing currently hung between the reel 24 and the injector 10. For example, the section of the coiled tubing 18 hung between the reel 24 and injector 10 may be identified based on the measured depth of the coiled tubing 18. The depth of the coiled tubing 18 may be measured by a depth sensor. The depth sensor may be mounted in a hydraulic console of the operator control cabin to receive readings from a tubing depth counter aligned to detect and sense a surface of the tubing 18 as the tubing 18 passes by using a mechanical digital counter or an encoder. Other means for detecting tubing depth may alternatively be incorporated. In another example, a sensor 410 may measure a current hydraulic pressure at which the reel drive motor 204 is operating. The hydraulic pressure may be measured by a pressure transducer.

The measured values of the parameters collected by sensors 410 are fed into the DAS 430. DAS 430 may be configured to additionally obtain several parameters related to one or more of properties of the coiled tubing 18, properties of the reel apparatus 200, properties of the injector 10, properties of a job category being performed using the coiled tubing and a job operation type being performed. Parameters related to properties of the coiled tubing may include, but are not limited to, outer diameter of the pipe 18, thickness of the pipe 18, yield strength of the pipe 18, bending radius of the pipe 18, and length of the pipe 18 between the reel 24 and coiled tubing guide 28. Parameters related to properties of the reel apparatus 200 may include, but are not limited to, core diameter of the reel 24, efficiency of the reel drive motor 204 and torque generated by the reel motor 204. Properties of the injector 10 may include, but are not limited to, length of the linear beam which applies a gripping force onto the gripper chains of the injector 10, area of the gripper cylinders that generate the required force to grip the coiled tubing 18 between the gripper chains, efficiency of the gripper cylinders, coiled tubing axial stress caused by coiled tubing hoisting load and coiled tubing internal pressure. A job category may refer to an application for which the coiled tubing 18 is being used including, for example, stimulation through acidizing or hydraulic fracturing, completion with plug millout, well integrity remediation by mechanical or chemical means, well clean out by removal of scale and/or organic deposition and diagnostic applications. The job category for which the coiled tubing 18 is being used may influence the reel back tension required for the tubing 18. Thus, one or more parameters related to the specific job category may be collected for use in determining the reel back tension. A job operation type may include the coiled tubing 18 being injected into the well 13 or being pulled out of the well 13. As described above, the required reel back tension and corresponding torque may vastly differ depending on whether the coiled tubing 18 is being injected into the well 13 or being pulled out of the well 13. For example, when pulling the coiled tubing 18 out of the well 13, a higher reel back tension may need to be maintained so that the pipe 18 is tightly wound onto the reel drum 202.

In an additional or alternative embodiment, the reel controller 440 may be configured to directly obtain one or more of the above described parameters (including corresponding parameter values). For example, the reel controller 440 may directly obtain measured values of one or parameters from respective sensors 410. The reel controller 440 may also be configured to obtain and/or determine one or more parameters (including corresponding parameter values) relating to properties of the coiled tubing 18, properties of the reel apparatus 200, properties of the injector 10, properties of a job category being performed using the coiled tubing and a job operation type being performed.

DAS 430 may be further configured to obtain a historical job dataset 442 including data relating to target reel back tension values previously set or observed over the duration of a previously performed coiled tubing operation, and/or corresponding hydraulic pressures previously set or observed for the reel motor 204 to achieve the respective reel back tension values. The reel back tension values and corresponding reel motor pressure values provided by the historical job dataset 442 for each set of parameter values were determined to be optimal for the set of parameter values. For example, the reel back tension values and corresponding reel motor pressure values provided by the historical job dataset 442 did not result in pipe buckling or cause pipe fatigue.

The historical job dataset 442 may include data collected over a given time period (days, weeks, months or years) while conducting coiled tubing operations by the same coiled tubing system 100 and/or by one or more other coiled tubing injector systems having similar properties including coiled tubing properties (e.g., coiled tubing outer diameter, coiled tubing thickness, coiled tubing yield strength, length of the pipe 18 between the reel 24 and coiled tubing guide 28 etc.) and surface equipment properties (core diameter of the reel 24, efficiency of the reel drive motor 204, torque generated by the reel motor 204, length of the linear beam which applies a gripping force onto the gripper chains of the injector 10, area of the gripper cylinders that generate the required force to grip the coiled tubing 18 between the gripper chains, efficiency of the gripper cylinders, coiled tubing axial stress caused by coiled tubing hoisting load and coiled tubing internal pressure etc.). In one embodiment, the historical job dataset 442 may include data collected over an entire coiled tubing operation including injecting the tubing 18 into the well 13 to a desired depth, performing an operation (e.g., well clean out, acidizing etc.) and pulling out the tubing 18 from the well 13 (including spooling back the tubing 18 on the reel 24).

For example, for a given set of parameters, the historical job dataset 442 may include target pressures values applied to the reel motor 204 and corresponding target reel back tensions resulting from the application of the target pressure values. The set of parameters may relate to a coiled tubing operation and may include, but is not limited to, one or more of coiled tubing outer diameter, measured depth, coiled tubing thickness, coiled tubing yield strength, length of the pipe 18 between the reel 24 and coiled tubing guide 28, core diameter of the reel 24, efficiency of the reel drive motor 204, torque generated by the reel motor 204, length of the linear beam which applied a gripping force onto the gripper chains of the injector 10, area of the gripper cylinders that generate the required force to grip the coiled tubing 18 between the gripper chains, efficiency of the gripper cylinders, coiled tubing axial stress caused by coiled tubing hoisting load and coiled tubing internal pressure, properties of a job category being performed using the coiled tubing and a job operation type being performed.

The historical job dataset 442 may include target reel motor pressure values and/or corresponding target reel back tension values for different combinations of the one or more parameters. Further, the historical job dataset 442 may include target reel motor pressure values and/or corresponding target reel back tension values for different combinations of values for a given set of parameters. For example, the historical job dataset 442 may include one or more previously set target reel motor pressure values and/or corresponding target reel back tension values applied for a given coiled tubing outer diameter, measured depth, coiled tubing thickness, coiled tubing yield strength, length of the pipe 18 between the reel 24 and coiled tubing guide 28, core diameter of the reel 24 and efficiency of the reel drive motor 204.

In one embodiment, the DAS 430 may be configured to obtain the historical job dataset 442 (e.g., from a data server, another computing system, via download from a portable data storage device etc.) and send the obtained historical job dataset 442 to the reel controller 440. The reel controller 440 may be configured to locally store the historical job dataset 442 in a memory of the reel controller 440. In an alternative embodiment, reel controller 440 may be configured to directly obtain the historical job dataset 442 and store the obtained dataset 442 in a local memory device of the reel controller 440.

Reel controller 440 may be configured to monitor a coiled tubing operation (e.g., including operation of the reel 24 and injector 10) based on values of one or more parameters obtained from DAS 430, and determine an optimized reel back tension to be applied to the coiled tubing 18 (e.g., including section of the coiled tubing 18 between reel 24 and injector 10) and corresponding optimized hydraulic pressure for the reel motor 204 (or motor pressure) to achieve the optimized reel back tension. The reel controller 440 may be configured to generate an electronic signal 446 based on the determined optimized reel motor pressure and send out the electronic signal 446 to the hydraulic reel control circuit 450.

The reel control circuit 450 is designed to adjust the hydraulic motor pressure of the reel motor 204. As shown in FIG. 4, the reel control circuit 450 includes a hydraulic pump 452 that provides hydraulic pressure for operating the reel control circuit 450. An electronically controlled electro-hydraulic valve 456 may be configured to receive a set-point for the target reel motor pressure from the reel controller 440 as an electronic signal and, in response, automatically actuate the valve 456 to regulate the pressure in the circuit 450 until the target set-point is reached in the hydraulic reel motor 204. A manually controlled hydraulic valve 454 may be connected in parallel to the electro-hydraulic valve 456 and can be used to manually adjust the hydraulic pressure of the reel motor 204, thereby providing manual over-ride capability to an operator.

Reel controller 440 may be configured to determine an estimated reel back tension of the coiled tubing 18 for a given set of parameters (including parameter values). In one or more embodiments, the reel controller 440 may be configured with a target angle of deployment of the coiled tubing 18 from the reel 24. The angle of deployment may refer to an angle between a linear axis of the coiled tubing 18 and a reference axis at a point of deployment where the coiled tubing leaves the reel into the air towards the coiled tubing guide 28. For example, the point of deployment of the tubing 18 from the reel 24 may include the levelwind assembly 208. The reference axis may be any imaginary vector originating from the point of deployment. For example, the reference axis may be an axis that is at a 90-degree angle from a tangential vector originating from the reel at the point of deployment. In one embodiment, the angle of deployment is selected by an operator based on prior experience. It may be appreciated that different reel back tensions of the tubing 18 between the reel 24 and injector 10 may result in different angles of deployment of the tubing 18 at the point of deployment form the reel 24. Thus, a specific angle of deployment corresponds to a specific reel back tension value or a specific range of reel back tension values. The target angle of deployment is usually set to a value that is known (e.g., from prior operator experience) to correspond to an optimal or near optimal reel back tension (e.g., a value that prevents pipe buckling/springing as well as pipe fatigue). Thus, it may be assumed that maintaining the preset target angle of deployment of the tubing 18 throughout the reel operation may maintain an optimal or near optimal reel back tension of the tubing 18.

For a given set of parameters (including parameter values), the reel controller 440 may be configured to determine an estimated reel back tension of the coiled tubing 18 to achieve the configured angle of deployment for the tubing 18. As described above, one or more parameter values (e.g., tubing bending radius, tubing thickness etc.) may change during the operation of the reel 24, thus changing the reel back tension needed to maintain the target angle of deployment of the coiled tubing 18. The reel controller 440 may be configured to continuously monitor the set of parameters (e.g., periodically, randomly, according to a pre-selected schedule etc.), and determine anew estimated reel back tension for a current set of parameter values after every monitoring event to maintain the target angle of deployment of the coiled tubing 18.

The reel controller 440 may be configured to adjust the estimated reel back tension based on the historical job dataset to generate an optimized target reel back tension to be applied to the coiled tubing 18. The historical job dataset 442 provides the reel controller 440 benefit of past experiences under similar conditions and a concrete guide to what target reel back tensions and corresponding target reel motor pressures can be optimal for the given conditions. For example, as described above, the historical job dataset 442 provides target reel back tension values and/or corresponding target reel motor pressure values that were determined to be optimal for a given set of conditions (e.g., set of parameters). Optimizing an estimated reel back tension value based on the historical job dataset 442 helps generate a target reel back tension value that is more accurate for the given set of conditions (e.g., parameters) thus minimizing or eliminating catastrophic pipe buckling or pipe damage.

As described above, the reel controller 440 may be configured to continuously monitor the set of parameters (e.g., periodically, randomly, according to a pre-selected schedule etc.), and determine a new estimated reel back tension for a current values of the set of parameters after every monitoring event to maintain the target angle of deployment of the coiled tubing 18. In one or more embodiments, every time an estimated reel back tension is determined, the reel controller 440 may be configured to also determine an optimized target reel back tension by adjusting the estimated reel back tension value based on the historical job dataset 442.

Once a target reel back tension is determined, the reel controller 440 may be configured to determine a target hydraulic motor pressure that is to be set for the reel motor 204 to achieve the determined target reel back tension. The reel controller 440 may send an electronic signal to the reel control circuit 450 (e.g., to electro-hydraulic valve 456) to adjust the hydraulic motor pressure of the reel motor 204 to the determined target motor pressure.

In one or more embodiments, the entire operation including monitoring a set of parameters related to the coiled tubing operation at various monitoring events, determining an estimated reel back tension based on the monitored parameter values after each monitoring event, determining an optimized target reel back tension by adjusting the estimated reel back tension, determining a target hydraulic pressure for the reel motor 204 as a function of the target reel back tension, and adjusting the hydraulic motor pressure to the target motor pressure is designed to be fully automatic and not needing operator intervention. Thus, the disclosed system and methods significantly reduce operator burden. Further, by automatically adjusting the reel back tension throughout the reel operation to maintain the target angle of deployment of the tubing 18, the reel controller 440 may ensure that the reel back tension at any point during the reel operation is not too low to prevent pipe buckling/springing or too high to damage the tubing 18.

In one or more embodiments, coiled tubing operations may be categorized into several job categories. As described above, the job category refers to an application for which the coiled tubing 18 is being used including, for example, stimulation through acidizing or hydraulic fracturing, completion with plug millout, well integrity remediation by mechanical or chemical means, well clean out by removal of scale and/or organic deposition and diagnostic applications. Mathematically, a variable 'K' may represent a set of defined job categories such that, $$K=\{k_i\}, \text{ where } i\in\{1, \ldots, N\}$$

$k_i$ represents a particular job category and N represents a number of defined coiled tubing job categories.

For each job category ($k_i$), two job operation types may be defined. As described above, a job operation type may include either injecting the coiled tubing 18 into well 13 or pulling out the coiled tubing 18 from the well 13. If a variable 'G' represents a set of coiled tubing job operation types, then G may be defined as, $$G=\{g_1\text{: injecting in well, } g_2\text{: Pulling out of well}\}$$

If P represents the total data set of estimated reel back tension values determined by reel controller 440 over an entire coiled tubing operation (including running tubing into the well and pulling tubing out of well) relating to a particular job category $k_i$, then $F^i$ may be defined as, $$F^i=\{f_j^i\}, \text{ where } j\in\{1, \ldots, M\}$$

M represents a number of individual reel back tension values determined for job category $k_i$ over the duration of the coiled tubing operation. Each of the M estimated reel back tension values may correspond to a different set of parameter values (e.g., determined based on a different set of parameter values). $F^i$ distributes uniformly over G. Thus, $F^i$ includes M/2 values relating to injecting the tubing 18 into the well 13 ($g_1$) and M/2 values relating to pulling the tubing 18 out of the well 13 ($g_2$).

The historical job data set 442 may also include M previously observed target reel back tension values for the same job category $k_i$. If $Y^i$ represents a set of target reel back tension values from historical job dataset 442 previously observed over the same entire coiled tubing operation relating to the job category $k_i$, then $Y^i$ may be defined as, $$Y^i=\{y_j^i\}, \text{ where } j\in\{1, \ldots, M\}$$

M in this context represents a number of previously observed target reel back tension values for job category $k_i$ over the duration of the coiled tubing operation.

For a given job category $k_i$, each of the observed target reel back tension values in set $Y^i$ has a corresponding estimated reel back tension value in set $F^i$, wherein a corresponding pair of observed target reel back tension value and estimated reel back tension value correspond to the same set of parameter values. That is, if an estimated reel back tension from set $F^i$ was determined by reel controller 440 based on a set of parameter values, the corresponding previously observed target reel back tension value from set $Y^i$ was observed for the same set of parameter values. In one embodiment, for an estimated reel back tension value in set $F^i$, the corresponding observed target reel back tension value in set $Y^i$ may represent a value manually set by the operator by adjusting the corresponding estimated value. Thus, one or more previously observed target reel back tension values from set $Y^i$ may be adjusted values of corresponding estimated reel back tension values in set $F^i$. Thus, the set $Y^i$ provides benefit of adjustments previously made to the reel back tension values under similar conditions. Additionally or alternatively, one or more observed target reel back tension values from the set $Y^i$ may have been determined by adjusting corresponding estimated reel back tension values in set $F^i$ based on the historical job dataset 442 as described below. Thus, the set $Y^i$ may provide benefit of previous adjustments made based on the historical dataset 442 under similar conditions.

Further, like $F^i$, $Y^i$ also distributes uniformly over G. Thus, like $F^i$, $Y^i$ includes M/2 values relating to injecting the tubing 18 into the well 13 ($g_1$) and M/2 values relating to pulling the tubing 18 out of the well 13 ($g_2$).

For a given job category $k_i$, reel controller 440 may be configured to compare one or more estimated reel back tension values from set $F^i$ with corresponding one or more observed reel back tension values from set $Y^i$ for the same job operation type (e.g., $g_1$ or $g_2$). For example, for a given job category $k_i$, reel controller 440 may be configured to compare M/2 estimated reel back tension values from set $F^i$ with corresponding M/2 observed reel back tension values from set $Y^i$ for the same job operation type (e.g., $g_1$ or $g_2$). Based on the comparison, reel controller 440 may generate a set $\beta^i$ which includes a distribution of all deviations or differences between the set $F^i$ and set $Y^i$. $\beta^i$ may be defined as, $$\beta_j^i=y_j^i-f_j^i$$

It may be noted that as $F^i$ and set $Y^i$ distribute uniformly over G, likewise $\beta^i$ distributes uniformly over G.

The reel controller 440 may be configured to generate an adjustment factor as $E[\beta^i|(G=g_s)]$, which represents a statistical expectation of error in determining an expected reel back tension value by the reel controller 440 in a particular job category, $k_i$, when a specific operation type $g_s \in G$, has occurred.

Once the adjustment factor is generated, the reel controller 440 may be configured to use the adjustment factor to adjust subsequently determined estimated reel back tension values. For example, when the reel controller 440 generates an estimated reel back tension F for a particular job category $k_i$ and a specific job operation type $g_s \in G$, the reel controller 440 may determine an adjusted/optimized target reel back tension F* as, $$F^*=F+\delta E[\beta^i|(G=g_s)]$$

δ is a hyperparameter that controls an extent of influence the adjustment factor has over the adjustment of the estimated reel back tension. For example, δ may be set to a value such that only a certain percentage of the adjustment factor is applied to F, instead of applying the entire adjustment. In an embodiment, a value of δ may be set by the operator. δ allows the operator to limit the amount of adjustment to avoid a large amount of adjustment from being made at one time.

Once the adjusted target reel back tension is determined, the reel controller 440 may determine a target hydraulic pressure for the reel motor 204 as a function of the target reel back tension. The reel controller may send an electronic signal to the reel control circuit 450 (e.g., electro-hydraulic valve 456) to adjust the hydraulic pressure of the reel motor 204 to the determined target hydraulic pressure. Adjusting the hydraulic pressure of the reel motor 204 to the determined target hydraulic pressure adjusts the reel back tension of the coiled tubing 18 to the determined target reel back tension.

In one or more embodiments, the reel controller 440 may be configured to continuously monitor parameters related to a coiled tubing operation and fine tune the reel back tension as needed (e.g., by determining and setting optimized reel back tensions as described above) to ensure that an optimal reel back tension continues to be applied to the coiled tubing throughout the duration of the coiled tubing operation.

In one or more embodiments, the reel controller 440 may be configured to add the adjusted reel back tension values and/or the corresponding target pressure values to the historical job dataset 442 for subsequent use in determining target reel back tensions and target pressures. For example, the reel controller 440 may record the adjusted reel back tension values generated over an entire cycle of coiled tubing operation (e.g., in a specific job category) in the historical job dataset 442 as observed values. The cycle of coiled tubing operation may include one or more of injecting coiled tubing 18 into the well 13 to a desired depth, pulling out the coiled tubing 18 from the well and spooling back on the reel 24. The updated historical job dataset 442 may then be used for determining adjusted target reel back tension values for a subsequent coiled tubing operation, thus fine tuning the optimization of reel back tension values.

In one or more embodiments, the reel controller 440 may be implemented by an artificial intelligence (AI) machine learning model. The AI model may be trained (e.g., in a training mode) using the historical job dataset 442 including the previously observed/applied target reel back tensions and corresponding applied target hydraulic pressures of the reel motor 204. The trained AI model may be used to determine optimized reel back tensions and reel motor pressures in real world conditions. The reel controller 440 may be configured to constantly update the AI model by adding newly set hydraulic motor pressures and corresponding applied reel back tensions to the historical job dataset 442 and updating the training of the AI model based on the updated historical data model 442. As more real-time data relating to hydraulic motor pressures and reel back tensions is added to the historical job dataset 442, the AI model may update itself thereby increasing the accuracy of determining optimized reel back tensions and hydraulic motor pressure values for a given set of parameter values.

Figure 5:
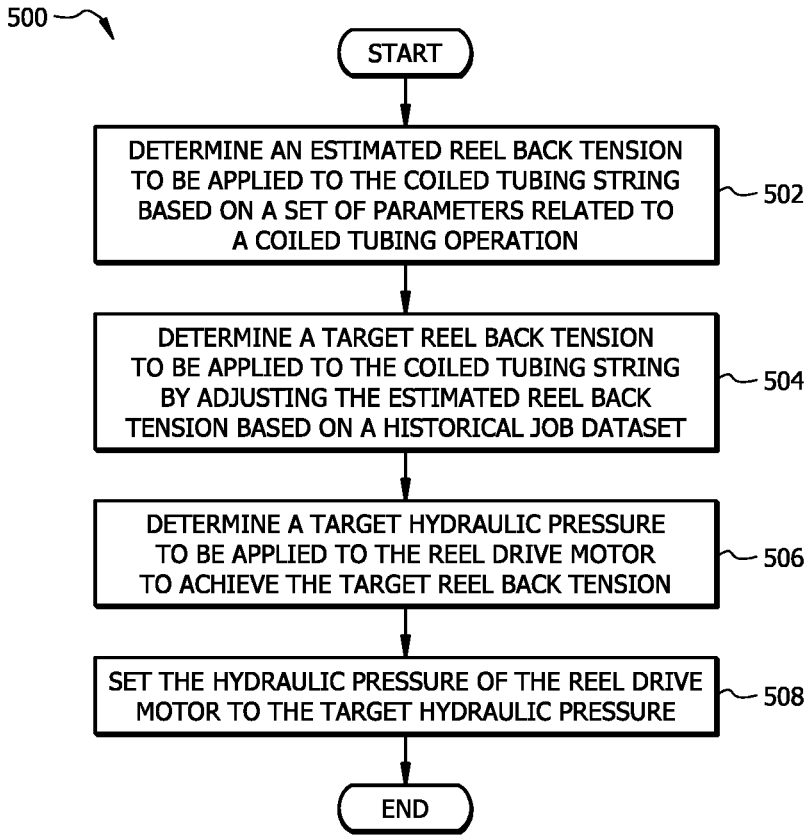
FIG. 5 illustrates example operations for determining an optimized reel back tension for a coiled tubing and corresponding optimized hydraulic pressure for a reel motor, in accordance with one or more embodiments of the present disclosure.

FIG. 5 illustrates example operations 500 for determining an optimized reel back tension for a coiled tubing 18 and corresponding optimized hydraulic pressure for a reel motor 204, in accordance with one or more embodiments of the present disclosure. Operations 500 may be implemented by a reel controller 440 as discussed above with reference to FIG. 4.

At step 502, reel controller 440 determines an estimated reel back tension to be applied to the portion of the coiled tubing string 18 between the coiled tubing reel apparatus 200 and injector apparatus 10, based on a set of parameters related to a coiled tubing operation being conducted using the coiled tubing reel apparatus 200 and the coiled tubing injector apparatus 10. The coiled tubing operation may include one or more of injecting the coiled tubing 18 into the well bore 13 and pulling out the coiled tubing 18 from the wellbore 13 (including spooling back the coiled tubing 18 on to the reel drum 202).

As described above, reel controller 440 may be configured to determine an estimated reel back tension of the coiled tubing 18 for a given set of parameters (including parameter values). The set of parameters may include at least one parameter relating to one or more of properties of the coiled tubing 18, properties of the reel apparatus 200, properties of the injector 10, properties of a job category being performed using the coiled tubing, a job operation type being performed and other miscellaneous sensor derived data.

DAS 430 may collect data relating to one or more parameters of the set of parameters. For example, as shown in FIG. 4, one or more sensors 410 may measure one or more parameters (e.g., tubing depth, current hydraulic pressure of reel motor 204, etc.) during the coiled tubing operation and feed the measured data to the DAS 430. DAS 430 may be configured to additionally obtain several parameters related to one or more of properties of the coiled tubing 18, properties of the reel apparatus 200, properties of the injector 10, properties of a job category being performed using the coiled tubing and a job operation type being performed. Parameters related to properties of the coiled tubing may include, but are not limited to, outer diameter of the pipe 18, thickness of the pipe 18, yield strength of the pipe 18, bending radius of the pipe 18, and length of the pipe 18 between the reel 24 and coiled tubing guide 28. Parameters related to properties of the reel apparatus 200 may include, but are not limited to, core diameter of the reel 24, efficiency of the reel drive motor 204 and torque generated by the reel motor 204. Properties of the injector 10 may include, but are not limited to, length of the linear beam which applies a gripping force onto the gripper chains of the injector 10, area of the gripper cylinders that generate the required force to grip the coiled tubing 18 between the gripper chains, efficiency of the gripper cylinders, coiled tubing axial stress caused by coiled tubing hoisting load and coiled tubing internal pressure. A job category may refer to an application for which the coiled tubing 18 is being used including, for example, stimulation through acidizing or hydraulic fracturing, completion with plug millout, well integrity remediation by mechanical or chemical means, well clean out by removal of scale and/or organic deposition and diagnostic applications. The DAS 430 may collect one or more parameters related to the specific job category of the coiled tubing operation. A job operation type may include the coiled tubing 18 being injected into the well 13 or being pulled out of the well 13. The DAS 430 may collect information relating to what job operation type is in progress.

Reel controller 440 may monitor the coiled tubing operation based on values of one or more parameters from the set of parameters obtained from DAS 430, and determine the estimated reel back tension to be applied to the coiled tubing 18 (e.g., including section of the coiled tubing 18 between reel 24 and injector 10) based on the obtained parameter values.

In one or more embodiments, the reel controller 440 may be configured with a target angle of deployment of the coiled tubing 18 from the reel 24. As described above, the angle of deployment may refer to an angle between a linear axis of the coiled tubing 18 and a reference axis at a point of deployment where the coiled tubing leaves the reel into the air towards the coiled tubing guide 28. In one embodiment, the angle of deployment is selected by an operator based on prior experience. The target angle of deployment may be preset to a value that is known (e.g., from prior operator experience) to correspond to an optimal or near optimal reel back tension (e.g., a value that prevents pipe buckling/springing as well as pipe fatigue). In one or more embodiments, for the given set of parameters (including parameter values), the reel controller 440 may determine the estimated reel back tension of the coiled tubing 18 to achieve the configured angle of deployment for the tubing 18. As described above, one or more parameter values (e.g., tubing bending radius, tubing thickness etc.) may change during the operation of the reel 24, thus changing the reel back tension needed to maintain the target angle of deployment of the coiled tubing 18. Thus, in one embodiment, the reel controller 440 may continuously monitor the set of parameters (e.g., periodically, randomly, according to a pre-selected schedule etc.), and determine a new estimated reel back tension for a current set of parameter values after every monitoring event to maintain the target angle of deployment of the coiled tubing 18.

At step 504, reel controller 440 determines a target reel back tension to be applied to the portion of the coiled tubing string 18 between the reel 24 and the injector 10 by adjusting the estimated reel back tension based on the historical job dataset 442, wherein the historical job dataset 442 includes at least one target reel back tension previously applied to the portion of the coiled tubing corresponding to the same set of parameters.

As described above, DAS 430 may be further configured to obtain a historical job dataset 442 including data relating to target reel back tension values previously set or observed over the duration of a previously performed coiled tubing operation, and/or corresponding hydraulic pressures previously set or observed for the reel motor 204 to achieve the respective reel back tension values. The reel back tension values and corresponding reel motor pressure values provided by the historical job dataset 442 for each set of parameter values were determined to be optimal for the set of parameter values. For example, the reel back tension values and corresponding reel motor pressure values provided by the historical job dataset 442 did not result in pipe buckling or cause pipe fatigue. In one embodiment, the historical job dataset 442 may include data collected over an entire (previously performed) coiled tubing operation including injecting the tubing 18 into the well 13 to a desired depth, performing an operation (e.g., well clean out, acidizing etc.) and pulling out the tubing 18 from the well 13 (including spooling back the tubing 18 on the reel 24).

As described above, the reel controller 440 may be configured to adjust the estimated reel back tension based on the historical job dataset 442 to generate an optimized target reel back tension to be applied to the coiled tubing 18. The historical job dataset 442 provides the reel controller 440 benefit of past experiences under similar conditions and a concrete guide to what target reel back tensions and corresponding target reel motor pressures can be optimal for the given conditions. For example, as described above, the historical job dataset 442 provides target reel back tension values and/or corresponding target reel motor pressure values that were determined to be optimal for a given set of conditions (e.g., set of parameters). Optimizing an estimated reel back tension value based on the historical job dataset 442 helps generate a target reel back tension value that is more accurate for the given set of conditions (e.g., parameters) thus minimizing or completely eliminating catastrophic pipe buckling or pipe damage.

In one or more embodiments, coiled tubing operations may be categorized into several job categories including, but not limited to, stimulation through acidizing or hydraulic fracturing, completion with plug millout, well integrity remediation by mechanical or chemical means, well clean out by removal of scale and/or organic deposition and diagnostic applications. Mathematically, a variable 'K' may represent a set of defined job categories such that, $$K=\{k_i\}, \text{ where } i\in\{1, \ldots, N\}$$

$k_i$ represents a particular job category and N represents a number of defined coiled tubing job categories.

For each job category ($k_i$), two job operation types may be defined including injecting the coiled tubing 18 into well 13 or pulling out the coiled tubing 18 from the well 13. If a variable 'G' represents a set of coiled tubing job operation types, then G may be defined as, $$G=\{g_1\text{: injecting in well, } g_2\text{: Pulling out of well}\}$$

If $F^i$ represents the total data set of estimated reel back tension values determined by reel controller 440 over a previously performed coiled tubing operation (including running tubing into the well and pulling tubing out of well) relating to a particular job category $k_i$, then $F^i$ may be defined as, $$F^i=\{f_j^i\}, \text{ where } j\in\{1, \ldots, M\}$$

M represents a number of individual reel back tension values determined for job category $k_i$ over the duration of the coiled tubing operation. Each of the M estimated reel back tension values may correspond to a different set of parameter values (e.g., determined based on a different set of parameter values). $F^i$ distributes uniformly over G. Thus, $F^i$ includes M/2 values relating to injecting the tubing 18 into the well 13 ($g_1$) and M/2 values relating to pulling the tubing 18 out of the well 13 ($g_2$).

The historical job data set 442 may also include M previously observed target reel back tension values for the same for the same job category $k_i$. If $Y^i$ represents a set of target reel back tension values from historical job dataset 442 previously observed over the same previously performed coiled tubing operation relating to the job category $k_i$, then $Y^i$ may be defined as, $$Y^i=\{y_j^i\}, \text{ where } j\in\{1, \ldots, M\}$$

M in this context represents a number of previously observed target reel back tension values for job category $k_i$ over the duration of the coiled tubing operation.

For a given job category $k_i$, each of the observed target reel back tension values in set $Y^i$ has a corresponding estimated reel back tension value in set F', wherein a corresponding pair of observed target reel back tension value and estimated reel back tension value correspond to the same set of parameter values. That is, if an estimated reel back tension from set $F^i$ was determined by reel controller 440 based on a set of parameter values, the corresponding previously observed target reel back tension value from set $Y^i$ was observed for the same set of parameter values. In one embodiment, for an estimated reel back tension value in set $F^i$, the corresponding observed target reel back tension value in set $Y^i$ may represent a value manually set by the operator by adjusting the corresponding estimated value. Thus, one or more previously observed target reel back tension values from set $Y^i$ may be adjusted values of corresponding estimated reel back tension values in set $F^i$. Thus, the set $Y^i$ provides benefit of adjustments previously made to the reel back tension values under similar conditions. Additionally or alternatively, one or more observed target reel back tension values from the set $Y^i$ may have been determined by adjusting corresponding estimated reel back tension values in set $F^i$ based on the historical job dataset 442 as described below. Thus, the set $Y^i$ may provide benefit of previous adjustments made based on the historical dataset 442 under similar conditions.

Further, like $F^i$, $Y^i$ also distributes uniformly over G. Thus, like $F^i$, $Y^i$ includes M/2 values relating to injecting the tubing 18 into the well 13 ($g_1$) and M/2 values relating to pulling the tubing 18 out of the well 13 ($g_2$).

For the given job category $k_i$, reel controller 440 may compare estimated reel back tension values from set $F^i$ with corresponding observed reel back tension values from set $Y^i$ for the same job operation type (e.g., $g_1$ or $g_2$). For example, for the given job category $k_i$, reel controller 440 may compare M/2 estimated reel back tension values from set $F^i$ with corresponding M/2 observed reel back tension values from set $Y^i$ for the same job operation type (e.g., $g_1$ or $g_2$). Based on the comparison, reel controller 440 may generate a set $\beta^i$ which includes a distribution of all deviations or differences between the set $F^i$ and set $Y^i$. $\beta^i$ may be defined as, $$\beta_j^i = y_j^i - f_j^i$$

It may be noted that as $F^i$ and set $Y^i$ distribute uniformly over G, likewise $\beta^i$ distributes uniformly over G.

The reel controller 440 may generate an adjustment factor as $E[\beta^i|(G=g_s)]$, which represents a statistical expectation of error in determining an expected reel back tension value by the reel controller 440 in the particular job category, $k_i$, when a specific operation type $g_s \in G$, has occurred.

Once the adjustment factor is generated, the reel controller 440 may use the adjustment factor to adjust subsequently determined estimated reel back tension values.

For example, when the reel controller 440 generates the estimated reel back tension F (from step 502) for the particular job category $k_i$ and the specific job operation type $g_s \in G$, the reel controller 440 may determine the adjusted/optimized target reel back tension F* as, $$F^* = F + \delta E[\beta^i|(G=g_s)]$$

δ is a hyperparameter that controls an extent of influence the adjustment factor has over the adjustment of the estimated reel back tension. For example, δ may be set to a value such that only a certain percentage of the adjustment factor is applied to F, instead of applying the entire adjustment. In an embodiment, a value of δ may be set by the operator. δ allows the operator to limit the amount of adjustment to avoid a large amount of adjustment from being made at one time.

At step 506, reel controller 440 determines a target hydraulic pressure to be applied to the reel drive motor 204 to achieve the target reel back tension in the portion of the coiled tubing string between the reel 24 and injector 10.

At step 508, reel controller sets the hydraulic pressure of the reel drive motor 204 to the target hydraulic pressure.

Once the adjusted target reel back tension is determined, the reel controller 440 may determine a target hydraulic pressure for the reel motor 204 as a function of the target reel back tension. Then the reel controller may send an electronic signal to the reel control circuit 450 (e.g., electro-hydraulic valve 456) to adjust the hydraulic pressure of the reel motor 204 to the determined target hydraulic pressure. Adjusting the hydraulic pressure of the reel motor 204 to the determined target hydraulic pressure adjusts the reel back tension of the coiled tubing 18 to the determined target reel back tension.

Figure 6:
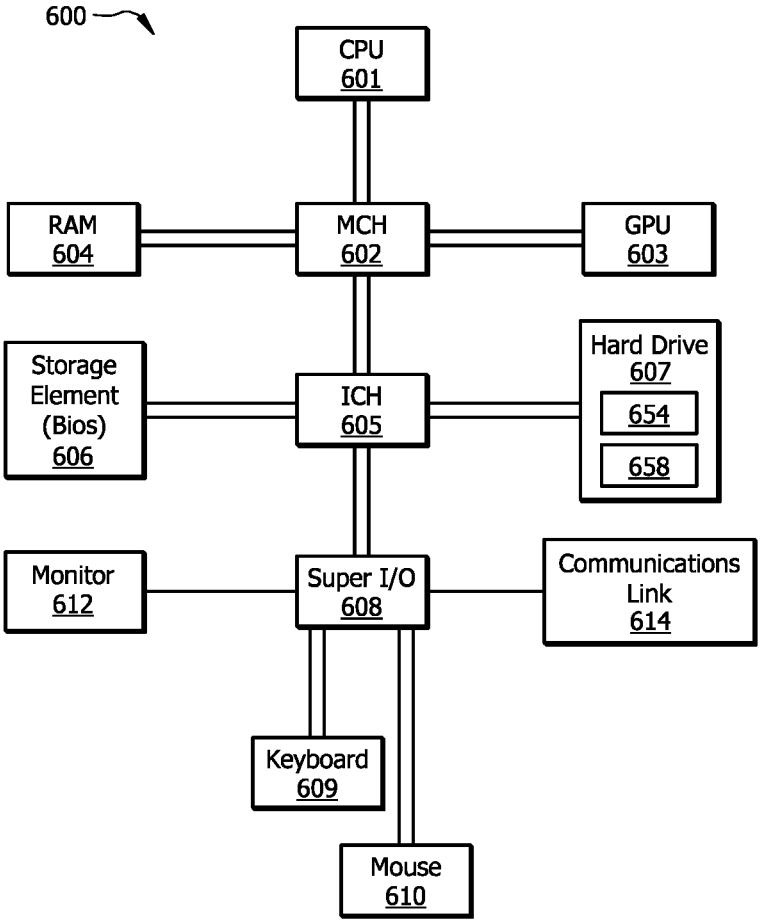
FIG. 6 is a diagram illustrating an example information handling system, in accordance with one or more embodiments of the present disclosure.

FIG. 6 is a diagram illustrating an example information handling system 600, for example, for use with coiled tubing injector system 100 of FIG. 1, coiled tubing reel apparatus 200 of FIG. 2 and/or system 300 shown in FIG. 3, in accordance with one or more embodiments of the present disclosure. The DAS 430 and/or the reel controller 440 discussed above with reference to FIGS. 4 and 5 may take a form similar to the information handling system 600. A processor or central processing unit (CPU) 601 of the information handling system 600 is communicatively coupled to a memory controller hub (MCH) or north bridge 602. The processor 601 may include, for example a microprocessor, microcontroller, digital signal processor (DSP), application specific integrated circuit (ASIC), or any other digital or analog circuitry configured to interpret and/or execute program instructions and/or process data. Processor 601 may be configured to interpret and/or execute program instructions or other data retrieved and stored in any memory such as memory 604 or hard drive 607. Program instructions or other data may constitute portions of a software or application, for example application 658 or data 654, for carrying out one or more methods described herein. Memory 604 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 658 or data 654 may be retrieved and stored in memory 604 for execution or use by processor 601. In one or more aspects, the memory 604 or the hard drive 607 may include or comprise one or more non-transitory executable instructions that, when executed by the processor 601 cause the processor 601 to perform or initiate one or more operations or steps. The information handling system 600 may be preprogrammed or it may be programmed (and reprogrammed) by loading a program from another source (for example, from a CD-ROM, from another computer device through a data network, or in another manner).

The data 654 may include treatment data, geological data, fracture data, seismic or micro seismic data, data relating to properties of the coiled tubing 18, data relating to properties of the reel apparatus 200, data relating to properties of the injector 10, data relating to measured parameters during a coiled tubing operation, data relating to a job category of a coiled tubing operation, data relating to a job operation type of a coiled tubing operation, or any other appropriate data. In one or more aspects, a memory of a computing device includes additional or different data, application, models, or other information. In one or more aspects, the data 654 may include geological data relating to one or more geological properties of the subterranean formation. For example, the geological data may include information on the wellbore, completions, or information on other attributes of the subterranean formation. In one or more aspects, the geological data includes information on the lithology, fluid content, stress profile (for example, stress anisotropy, maximum and minimum horizontal stresses), pressure profile, spatial extent, or other attributes of one or more rock formations in the subterranean zone. The geological data may include information collected from well logs, rock samples, outcroppings, seismic or microseismic imaging, or other data sources.

The one or more applications 658 may comprise one or more software applications, one or more scripts, one or more programs, one or more functions, one or more executables, or one or more other modules that are interpreted or executed by the processor 601. The one or more applications 658 may include one or more machine-readable instructions for performing one or more of the operations related to any one or more aspects of the present disclosure. The one or more applications 658 may include machine-readable instructions for determining optimized reel back tensions and hydraulic reel motor pressures, as described with reference to FIGS. 1-5. The one or more applications 658 may obtain input data, such as data relating to properties of the coiled tubing 18, data relating properties of the reel apparatus 200, data relating to properties of the injector 10, data relating to measured parameters during a coiled tubing operation, data relating to a job category and job operation type of the coiled tubing operation, seismic data, well data, treatment data, geological data, fracture data, or other types of input data, from the memory 604, from another local source, or from one or more remote sources (for example, via the one or more communication links 614). The one or more applications 658 may generate output data and store the output data in the memory 604, hard drive 607, in another local medium, or in one or more remote devices (for example, by sending the output data via the communication link 614).

Modifications, additions, or omissions may be made to FIG. 6 without departing from the scope of the present disclosure. For example, FIG. 6 shows a particular configuration of components of information handling system 600. However, any suitable configurations of components may be used. For example, components of information handling system 600 may be implemented either as physical or logical components. Furthermore, in one or more aspects, functionality associated with components of information handling system 600 may be implemented in special purpose circuits or components. In other aspects, functionality associated with components of information handling system 600 may be implemented in configurable general purpose circuit or components. For example, components of information handling system 600 may be implemented by configured computer program instructions.

Memory controller hub 602 may include a memory controller for directing information to or from various system memory components within the information handling system 600, such as memory 604, storage element 606, and hard drive 607. The memory controller hub 602 may be coupled to memory 604 and a graphics processing unit (GPU) 603. Memory controller hub 602 may also be coupled to an I/O controller hub (ICH) or south bridge 605. I/O controller hub 605 is coupled to storage elements of the information handling system 600, including a storage element 606, which may comprise a flash ROM that includes a basic input/output system (BIOS) of the computer system. I/O controller hub 605 is also coupled to the hard drive 607 of the information handling system 600. I/O controller hub 605 may also be coupled to an I/O chip or interface, for example, a Super I/O chip 608, which is itself coupled to several of the I/O ports of the computer system, including a keyboard 609, a mouse 610, a monitor 612 and one or more communications link 614. Any one or more input/output devices receive and transmit data in analog or digital form over one or more communication links 614 such as a serial link, a wireless link (for example, infrared, radio frequency, or others), a parallel link, or another type of link. The one or more communication links 614 may comprise any type of communication channel, connector, data communication network, or other link. For example, the one or more communication links 614 may comprise a wireless or a wired network, a Local Area Network (LAN), a Wide Area Network (WAN), a private network, a public network (such as the Internet), a wireless fidelity or WiFi network, a network that includes a satellite link, or another type of data communication network.

One or more embodiments of the present disclosure provide a system including a coiled tubing reel apparatus comprising: a reel drum for storing a coiled tubing string spooled on the reel drum and capable of rotating on a central axis to dispense the coiled tubing string or spool-in the coiled tubing string; and a hydraulic reel drive motor operatively coupled to the reel drum, wherein the reel drive motor controls rotation of the reel drum by applying a torque to the reel drum for maintaining a reel back tension on a portion of the coiled tubing string between the coiled tubing reel apparatus and a coiled tubing guide of a coiled tubing injector apparatus. The system further includes an automatic reel controller configured to: determine a target hydraulic pressure to be applied to the reel drive motor to achieve a target reel back tension in the portion of the coiled tubing string; and set a hydraulic pressure of the reel drive motor to the target hydraulic pressure.

In one or more embodiments, the automatic reel controller is further configured to: determine an estimated reel back tension to be applied to the portion of the coiled tubing string, based on a set of parameters related to a coiled tubing operation being conducted using the coiled tubing reel apparatus and the coiled tubing injector apparatus; and determine the target reel back tension to be applied to the portion of the coiled tubing string by adjusting the estimated reel back tension.

In one or more embodiments, the estimated reel back tension is adjusted based on a historical job dataset, wherein the historical job dataset includes at least one target reel back tension previously applied to the portion of the coiled tubing corresponding to the same set of parameters.

In one or more embodiments, the set of parameters includes at least one of one or more properties of the coiled tubing string, one or more properties of the coiled tubing reel apparatus, one or more properties of the coiled tubing injector apparatus or one or more parameters related to the coiled tubing operation.

In one or more embodiments, the historical job dataset comprises a set ($Y^i$) of previously applied target reel back tension values for each job category ($k_i$) of a plurality of coiled tubing job categories;

wherein:

$$K=\{k_i\}, \text{ where } i\in\{1, \ldots, N\};$$

K represents the collection of the plurality of coiled tubing job categories;

N represents a number of coiled tubing job categories in the plurality of coiled tubing job categories;

$$Y^i=\{y_j^i\}, \text{ where } j\in\{1, \ldots, M\};$$

$Y^i$ represents the set of previously applied target reel back tension values for a job category ($k_i$) from the historical job dataset;

M represents a number of previously applied target reel back tension values in a job category ($k_i$)

In one or more embodiments, each of M values corresponds to a different set of values for the set of parameters.

In one or more embodiments, for each job category ($k_i$), the historical job data set comprises M/2 target reel back tension values for each of two job operation types including running the coiled tubing string into a wellbore and running the coiled tubing string out of the wellbore.

In one or more embodiments, the reel controller is further configured to: obtain a first set of M/2 estimated reel back tension values determined during a previous coiled tubing operation of a first job operation type in a first job category; obtain, from the historical job dataset, a second set of M/2 target reel back tension values observed during the previous coiled tubing operation of the first job operation type in the first job category; determine a set of deviations by comparing the first set with the second set; and determine an adjustment factor based on the set of deviations, wherein the adjustment factor represents an expectation of error in determining estimated reel back tension values by the reel controller.

In one or more embodiments, the reel controller is configured to determine the target reel back tension to be applied to the portion of the coiled tubing by adding the adjustment factor to the estimated reel back tension.

In one or more embodiments, the reel controller is further configured to: obtain a hyperparameter for controlling an extent of adjustment applied to the estimated reel back tension;

determine a modified adjustment factor by multiplying the hyperparameter to the adjustment factor; and determine the target reel back tension to be applied to the portion of the coiled tubing by adding the modified adjustment factor to the estimated reel back tension.

In one or more embodiments, the automatic reel controller is implemented by a machine learning model trained, at least in part, based on the historical job dataset.

In one or more embodiments, the reel controller is further configured to: add the target reel back tension to the historical job dataset to generate a modified historical job dataset; and adjust a subsequently determined estimated reel back tension value based on the modified historical job dataset.

One or more embodiments of the present disclosure provide a method for operating a coiled tubing reel apparatus, comprising: automatically determining a target hydraulic pressure to be applied to a reel drive motor to achieve a target reel back tension in a portion of a coiled tubing string between the coiled tubing reel apparatus and a coiled tubing guide of a coiled tubing injector apparatus; and automatically setting a hydraulic pressure of the reel drive motor to the target hydraulic pressure.

In one or more embodiments, the method further includes, determining an estimated reel back tension to be applied to the portion of the coiled tubing string, based on a set of parameters related to a coiled tubing operation being conducted using the coiled tubing reel apparatus and the coiled tubing injector apparatus; and determining the target reel back tension to be applied to the portion of the coiled tubing string by adjusting the estimated reel back tension.

In one or more embodiments, the estimated reel back tension is adjusted based on a historical job dataset, wherein the historical job dataset includes at least one target reel back tension previously applied to the portion of the coiled tubing corresponding to the same set of parameters.

In one or more embodiments, the historical job dataset comprises a set ($Y^i$) of previously applied target reel back tension values for each job category ($k_i$) of a plurality of coiled tubing job categories;

wherein:

$$K=\{k_i\}, \text{ where } i\in\{1, \ldots, N\};$$

K represents the collection of the plurality of coiled tubing job categories;

N represents a number of coiled tubing job categories in the plurality of coiled tubing job categories;

$$Y^i=\{y_j^i\}, \text{ where } j\in\{1, \ldots, M\};$$

$Y^i$ represents the set of previously applied target reel back tension values for a job category ($k_i$) from the historical job dataset;

M represents a number of previously applied target reel back tension values in a job category ($k_i$).

In one or more embodiments, for each job category ($k_i$), the historical job data set comprises M/2 target reel back tension values for each of two job operation types including running the coiled tubing string into a wellbore and running the coiled tubing string out of the wellbore.

In one or more embodiments, the method further comprises obtaining a first set of M/2 estimated reel back tension values determined during a previous coiled tubing operation of a first job operation type in a first job category; obtaining, from the historical job dataset, a second set of M/2 target reel back tension values observed during the previous coiled tubing operation of the first job operation type in the first job category; determining a set of deviations by comparing the first set with the second set; and determining an adjustment factor based on the set of deviations, wherein the adjustment factor represents an expectation of error in determining estimated reel back tension values by the reel controller.

In one or more embodiments, determining the target reel back tension comprises determining the target reel back tension by adding the adjustment factor to the estimated reel back tension.

In one or more embodiments, the method comprises obtaining a hyperparameter for controlling an extent of adjustment applied to the estimated reel back tension; determining a modified adjustment factor by multiplying the hyperparameter to the adjustment factor; and determining the target reel back tension to be applied to the portion of the coiled tubing by adding the modified adjustment factor to the estimated reel back tension.

One or more embodiments of the present disclosure provide a computer-readable medium storing instructions which when processed by at least one processor perform a method for operating a coiled tubing reel apparatus, comprising: automatically determining a target hydraulic pressure to be applied to a reel drive motor to achieve a target reel back tension in a portion of a coiled tubing string between the coiled tubing reel apparatus and a coiled tubing guide of a coiled tubing injector apparatus; and automatically setting a hydraulic pressure of the reel drive motor to the target hydraulic pressure.

In one or more embodiments, the computer-readable medium further comprises instructions for determining an estimated reel back tension to be applied to the portion of the coiled tubing string, based on a set of parameters related to a coiled tubing operation being conducted using the coiled tubing reel apparatus and the coiled tubing injector apparatus; and determining the target reel back tension to be applied to the portion of the coiled tubing string by adjusting the estimated reel back tension.

In one or more embodiments, the estimated reel back tension is adjusted based on a historical job dataset, wherein the historical job dataset includes at least one target reel back tension previously applied to the portion of the coiled tubing corresponding to the same set of parameters.

In one or more embodiments, the historical job dataset comprises a set ($Y^i$) of previously applied target reel back tension values for each job category ($k_i$) of a plurality of coiled tubing job categories;

wherein:

$$K=\{k_i\}, \text{ where } i\in\{1, \ldots, N\};$$

K represents the collection of the plurality of coiled tubing job categories;

N represents a number of coiled tubing job categories in the plurality of coiled tubing job categories;

$$Y^i=\{y_j^i\}, \text{ where } j\in\{1, \ldots, M\};$$

$Y^i$ represents the set of previously applied target reel back tension values for a job category ($k_i$) from the historical job dataset;

M represents a number of previously applied target reel back tension values in a job category ($k_i$).

In one or more embodiments, for each job category ($k_i$), the historical job data set comprises M/2 target reel back tension values for each of two job operation types including running the coiled tubing string into a wellbore and running the coiled tubing string out of the wellbore.

In one or more embodiments, the computer-readable medium further comprises instructions for: obtaining a first set of M/2 estimated reel back tension values determined during a previous coiled tubing operation of a first job operation type in a first job category; obtaining, from the historical job dataset, a second set of M/2 target reel back tension values observed during the previous coiled tubing operation of the first job operation type in the first job category; determining a set of deviations by comparing the first set with the second set; and determining an adjustment factor based on the set of deviations, wherein the adjustment factor represents an expectation of error in determining estimated reel back tension values by the reel controller.

In one or more embodiments, determining the target reel back tension comprises determining the target reel back tension by adding the adjustment factor to the estimated reel back tension.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

What is claimed is:

1. A system comprising:

a coiled tubing reel apparatus comprising:

a reel drum for storing a coiled tubing string spooled on the reel drum and capable of rotating on a central axis to dispense the coiled tubing string or spool-in the coiled tubing string;

a hydraulic reel drive motor operatively coupled to the reel drum, wherein the reel drive motor controls rotation of the reel drum by applying a torque to the reel drum, wherein applying the torque generates a reel back tension on a portion of the coiled tubing string between the coiled tubing reel apparatus and a coiled tubing guide of a coiled tubing injector apparatus, and wherein an angle of deployment of the coiled tubing string from the reel drum is based at least in part on the reel back tension in the portion of the coiled tubing string between the coiled tubing reel apparatus and the coiled tubing guide of the coiled tubing injector apparatus; and an automatic reel controller configured to:

determine a target hydraulic pressure to be applied to the reel drive motor to achieve a target reel back tension to maintain a target angle of deployment for the coiled tubing string; and set a hydraulic pressure of the reel drive motor to the target hydraulic pressure.

2. The system of claim 1, wherein the automatic reel controller is further configured to:

determine an estimated reel back tension to be applied to the portion of the coiled tubing string, based on a set of parameters related to a coiled tubing operation being conducted using the coiled tubing reel apparatus and the coiled tubing injector apparatus; and determine the target reel back tension to be applied to the portion of the coiled tubing string by adjusting the estimated reel back tension.

3. The system of claim 2, wherein the estimated reel back tension is adjusted based on a historical job dataset, wherein the historical job dataset includes at least one target reel back tension previously applied to the portion of the coiled tubing corresponding to the same set of parameters.

4. The system of claim 3, wherein the historical job dataset comprises a set ($Y^i$) of previously applied target reel back tension values for each job category ($k_i$) of a plurality of coiled tubing job categories;

wherein:

$$K=\{k_i\}, \text{ where } i\in\{1, \ldots, N\};$$

K represents the collection of the plurality of coiled tubing job categories;

N represents a number of coiled tubing job categories in the plurality of coiled tubing job categories;

$$Y^i=\{y_j^i\}, \text{ where } j\in\{1, \ldots, M\};$$

$Y^i$ represents the set of previously applied target reel back tension values for a job category ($k_i$)from the historical job dataset;

M represents a number of previously applied target reel back tension values in a job category ($k_i$).

5. The system of claim 4, wherein each of M values corresponds to a different set of values for the set of parameters.

6. The system of claim 4, wherein for each job category ($k_i$), the historical job data set comprises M/2 target reel back tension values for each of two job operation types including running the coiled tubing string into a wellbore and running the coiled tubing string out of the wellbore.

7. The system of claim 6, wherein the automatic reel controller is further configured to:

obtain a first set of M/2 estimated reel back tension values determined during a previous coiled tubing operation of a first job operation type in a first job category;

obtain, from the historical job dataset, a second set of M/2 target reel back tension values observed during the previous coiled tubing operation of the first job operation type in the first job category;

determine a set of deviations by comparing the first set with the second set; and determine an adjustment factor based on the set of deviations, wherein the adjustment factor represents an expectation of error in determining estimated reel back tension values by the automatic reel controller.

8. The system of claim 7, wherein the automatic reel controller is configured to determine the target reel back tension to be applied to the portion of the coiled tubing by adding the adjustment factor to the estimated reel back tension.

9. The system of claim 8, wherein the automatic reel controller is further configured to:

obtain a hyperparameter for controlling an extent of adjustment applied to the estimated reel back tension;

determine a modified adjustment factor by multiplying the hyperparameter to the adjustment factor; and determine the target reel back tension to be applied to the portion of the coiled tubing by adding the modified adjustment factor to the estimated reel back tension.

10. The system of claim 3, wherein the automatic reel controller is further configured to:

add the target reel back tension to the historical job dataset to generate a modified historical job dataset; and adjust a subsequently determined estimated reel back tension value based on the modified historical job dataset.

11. The system of claim 3, wherein the automatic reel controller is implemented by a machine learning model trained, at least in part, based on the historical job dataset.

12. The system of claim 2, wherein the set of parameters includes at least one of one or more properties of the coiled tubing string, one or more properties of the coiled tubing reel apparatus, one or more properties of the coiled tubing injector apparatus or one or more parameters related to the coiled tubing operation.

13. The system of claim 1, further comprising a levelwind assembly configured to adjust a height of the coiled tubing string proximate a point of deployment of the coiled tubing string from the reel drum, and wherein the angle of deployment of the coiled tubing string from the reel drum is based at least in part on the reel back tension and a position of the levelwind assembly.

14. The system of claim 1, wherein the angle of deployment is defined as an angle between a linear axis of the coiled tubing and a reference axis at a point of deployment where the coiled tubing leaves the reel drum into the air towards the coiled tubing guide, and wherein reference axis may be an axis that is at a 90-degree angle from a tangential vector originating from the reel drum at the point of deployment.

15. A method for operating a coiled tubing reel apparatus, comprising:

automatically determining a target hydraulic pressure to be applied to a reel drive motor to achieve a target reel back tension in a portion of a coiled tubing string between the coiled tubing reel apparatus and a coiled tubing guide of a coiled tubing injector apparatus, wherein an angle of deployment of the coiled tubing string from the coiled tubing reel apparatus is based at least in part on the reel back tension in the portion of the coiled tubing string between the coiled tubing reel apparatus and the coiled tubing guide of the coiled tubing injector apparatus; and automatically setting a hydraulic pressure of the reel drive motor to the target hydraulic pressure to maintain a target angle of deployment for the coiled tubing string.

16. The method of claim 15, further comprising:

determining an estimated reel back tension to be applied to the portion of the coiled tubing string, based on a set of parameters related to a coiled tubing operation being conducted using the coiled tubing reel apparatus and the coiled tubing injector apparatus; and determining the target reel back tension to be applied to the portion of the coiled tubing string by adjusting the estimated reel back tension.

17. The method of claim 16, wherein the estimated reel back tension is adjusted based on a historical job dataset, wherein the historical job dataset includes at least one target reel back tension previously applied to the portion of the coiled tubing corresponding to the same set of parameters.

18. The method of claim 17, wherein the historical job dataset comprises a set ($Y^i$) of previously applied target reel back tension values for each job category ($k_i$) of a plurality of coiled tubing job categories;

wherein:

$$K=\{k^i\}, \text{ where } i\in\{1, \ldots, N\};$$

K represents the collection of the plurality of coiled tubing job categories;

N represents a number of coiled tubing job categories in the plurality of coiled tubing job categories;

$$Y^i=\{y_j^i\}, \text{ where } j\in\{1, \ldots, M\};$$

$Y^i$ represents the set of previously applied target reel back tension values for a job category ($k_i$) from the historical job dataset;

M represents a number of previously applied target reel back tension values in a job category ($k_i$).

19. The method of claim 18, wherein for each job category ($k_i$), the historical job data set comprises M/2 target reel back tension values for each of two job operation types including running the coiled tubing string into a wellbore and running the coiled tubing string out of the wellbore.

20. The method of claim 19, further comprising:

obtaining a first set of M/2 estimated reel back tension values determined during a previous coiled tubing operation of a first job operation type in a first job category;

obtaining, from the historical job dataset, a second set of M/2 target reel back tension values observed during the previous coiled tubing operation of the first job operation type in the first job category;

determining a set of deviations by comparing the first set with the second set; and determining an adjustment factor based on the set of deviations, wherein the adjustment factor represents an expectation of error in determining estimated reel back tension values by the reel controller.

21. The method of claim 20, wherein determining the target reel back tension comprises determining the target reel back tension by adding the adjustment factor to the estimated reel back tension.

22. The method of claim 21, further comprising:

obtaining a hyperparameter for controlling an extent of adjustment applied to the estimated reel back tension;

determining a modified adjustment factor by multiplying the hyperparameter to the adjustment factor; and determining the target reel back tension to be applied to the portion of the coiled tubing by adding the modified adjustment factor to the estimated reel back tension.

23. A computer-readable medium storing instructions which when processed by at least one processor perform a method for operating a coiled tubing reel apparatus, comprising:

automatically determining a target hydraulic pressure to be applied to a reel drive motor to achieve a target reel back tension in a portion of a coiled tubing string between the coiled tubing reel apparatus and a coiled tubing guide of a coiled tubing injector apparatus, wherein an angle of deployment of the coiled tubing string from the coiled tubing reel apparatus is based at least in part on the reel back tension in the portion of the coiled tubing string between the coiled tubing reel apparatus and the coiled tubing guide of the coiled tubing injector apparatus; and automatically setting a hydraulic pressure of the reel drive motor to the target hydraulic pressure to maintain a target angle of deployment for the coiled tubing string.

24. The computer-readable medium of claim 23, further comprising instructions for:

determining an estimated reel back tension to be applied to the portion of the coiled tubing string, based on a set of parameters related to a coiled tubing operation being conducted using the coiled tubing reel apparatus and the coiled tubing injector apparatus; and determining the target reel back tension to be applied to the portion of the coiled tubing string by adjusting the estimated reel back tension.

25. The computer-readable medium of claim 24, wherein the estimated reel back tension is adjusted based on a historical job dataset, wherein the historical job dataset includes at least one target reel back tension previously applied to the portion of the coiled tubing corresponding to the same set of parameters.

26. The computer-readable medium of claim 25, wherein the historical job dataset comprises a set (Y') of previously applied target reel back tension values for each job category (k) of a plurality of coiled tubing job categories;

wherein:

$K=\{K^i\}$, where $i\in\{1, \ldots, N\}$;

K represents the collection of the plurality of coiled tubing job categories;

N represents a number of coiled tubing job categories in the plurality of coiled tubing job categories;

$Yi=\{y_j^i\}$, where $j\in\{1, \ldots, M\}$;

Yi represents the set of previously applied target reel back tension values for a job category ($k_i$) from the historical job dataset;

M represents a number of previously applied target reel back tension values in a job category ($k_i$).

27. The computer-readable medium of claim 26, wherein for each job category (ki), the historical job data set comprises M/2 target reel back tension values for each of two job operation types including running the coiled tubing string into a wellbore and running the coiled tubing string out of the wellbore.

* * * * *